US009060581B2

(12) United States Patent
Lown et al.

(10) Patent No.: US 9,060,581 B2
(45) Date of Patent: Jun. 23, 2015

(54) PICNIC ORGANIZER PACKAGE BAGGING SYSTEM

(71) Applicant: LIFETIME BRANDS, INC., Garden City, NY (US)

(72) Inventors: Aaron Lown, Tuxedo, NY (US); John Roscoe Swartz, Ridgewood, NJ (US)

(73) Assignee: LIFETIME BRANDS, INC., Garden City, NY (US)

( * ) Notice: Subject to any disclaimer, the term of this patent is extended or adjusted under 35 U.S.C. 154(b) by 0 days.

(21) Appl. No.: 14/099,097

(22) Filed: Dec. 6, 2013

(65) Prior Publication Data

US 2014/0185963 A1 Jul. 3, 2014

Related U.S. Application Data

(60) Provisional application No. 61/748,583, filed on Jan. 3, 2013.

(51) Int. Cl.

| | |
|---|---|
| ***A45C 11/20*** | (2006.01) |
| ***A45F 3/46*** | (2006.01) |
| ***A45C 7/00*** | (2006.01) |
| ***A45C 13/02*** | (2006.01) |
| ***A45C 15/00*** | (2006.01) |
| *A45C 13/10* | (2006.01) |

(52) U.S. Cl.

CPC . *A45C 11/20* (2013.01); *A45F 3/46* (2013.01); *A45C 7/0086* (2013.01); *A45C 7/0095* (2013.01); *A45C 13/02* (2013.01); *A45C 13/103* (2013.01); *A45C 13/1046* (2013.01); *A45C 15/00* (2013.01); *A45C 2007/0004* (2013.01); *A45C 2200/20* (2013.01)

(58) Field of Classification Search

CPC .... A45C 7/0086; A45C 7/0095; A45C 13/02; A45C 13/103; A45C 13/1046; A45C 15/00; A45C 2007/0004; A45C 2200/20; A45F 3/46

USPC ..... 206/541–549; 190/1, 2, 107, 110; 383/4

See application file for complete search history.

(56) References Cited

U.S. PATENT DOCUMENTS

| | | | | |
|---|---|---|---|---|
| 4,489,815 | A * | 12/1984 | Martinez et al. | 190/1 |
| 4,781,277 | A * | 11/1988 | Lim | 190/1 |
| 5,445,276 | A * | 8/1995 | Gordon | 206/545 |
| 6,409,066 | B1 * | 6/2002 | Schneider et al. | 206/545 |
| 6,994,131 | B2 * | 2/2006 | Dedmon | 206/541 |
| 7,845,508 | B2 * | 12/2010 | Rothschild et al. | 190/107 |
| 2006/0027475 | A1 * | 2/2006 | Gleason et al. | 190/110 |

FOREIGN PATENT DOCUMENTS

| | | | |
|---|---|---|---|
| GB | 2331232 | A * | 5/1999 |

* cited by examiner

*Primary Examiner* — Bryon Gehman

(74) *Attorney, Agent, or Firm* — Tutunjian & Bitetto, P.C.

(57) ABSTRACT

A foldable organizer bagging system. Plurality of pieces durable fabrics are seamed to form a flat sheet with a zipping mechanism mounted at two opposing sides and allows use as a picnic tote. On these plurality pieces of durable fabrics, multiple slotted pockets are attached to hold dishware, glassware and napkin and utensils. With a zipping motion, two side pieces fold into the bottom piece and the flat sheet forms a bagging system with a internal spacing for containing an anchored and separate bag for containing food and other items.

7 Claims, 12 Drawing Sheets

PICNIC ORGANIZER PACKAGE BAGGING SYSTEM

CROSS REFERENCE TO RELATED APPLICATIONS

This application relates to and claims priority from U.S. Prov. Ser. No. 61/748,583 filed Jan. 3, 2013, the entire contents of which are incorporated by reference; and is additionally related to U.S. Design Ser. No. 29/441,278 filed Jan. 3, 2013, the entire contents of which are also incorporated by reference.

FIGURE SELECTED FOR PUBLICATION

FIG. 6

BACKGROUND OF THE INVENTION

1. Field of the Invention

The present invention relates to an organizer system, and more particularly to a foldable picnic bagging system for organizing and carrying all necessary items for a full table set needed for picnic settings with style.

2. Description of the Related Art

Various organizers and carriers have been developed for many different purposes. Such examples include tool boxes for organizing and carrying ready-to-use tools specialized for different professions. With the aid of these organizers, people conduct their jobs and businesses with ease and efficiency.

For pleasurable activities outdoor living is popular. A meal served in the open and away, and in the wildness of natural views is generally relaxing, romantic and stimulating. But a picnic activity generally suffers in comforts by the limitations in carrying food supplies and table-wares. It adds to the enjoyment to have utensils, dishes and other customary items of style and fashion to set up a picnic setting. Having a readily available cover or tablecloth to spread, wine glasses to drink, napkins to use, at the desired site further adds to the convenience and enjoyment of the meal. For these added luxury style and fashion, it generally takes a great amount of effort in initiating and preparing for such an outdoor picnic eating.

It provides more efficiency and ease if picnic items can be organized and carried with a minimum of transportation difficulty. Picnic baskets and various containers permitting the storage of utensils and food items are the traditional means for transporting and carrying picnic items. However, these bulky containers are hardly efficient organizers, and also add weight to the already burdened picnic transportation, many times involving children and families.

Accordingly, there is a need for an efficient picnic organizer and carrier that is capable of carrying a full table set of items ready to be set up for a pleasurable meal for a group of people with fashion and style in the open of the wildness.

ASPECTS AND SUMMARY OF THE INVENTION

In response, a foldable picnic organizer bagging system is disclosed and is positionable in a compacted/transport position and an expanded/use position.

A foldable fabric cover sheet with four peripheral sides is formed by symmetrically conjugating a plurality of pieces of durable fabric materials for folding via a plurality of seams creating flexible folding panels. A pair of peripheral zipper couples are sewn to two opposite sides for pulling and fixing the cover sheet into a bagging system, while the other two opposing sides are mounted with continuous carrying strings for forming hand carrying short double loops or shoulder carrying single long loops.

The cover sheet is consisting of at least two layers in needed locations as will be discussed. It is noted that one sheet may be alternatively used and a covering layer applied in desired location to provided pockets, as will be discussed. A central generally rectilinear (4-sided) or rectangular piece material that forms the bottom of the bagging comprises at least four slotted holders, one at each corner for securely holding for glass-wares. At two opposing sides are positioned with two side pieces that are capable of being folded into three packed pieces. VELCRO® type hook and loop members are mounted to the central piece for holding the folding sides when a bagging is formed. A small pouch may be removably-attached to the foldable sides for storing small items, such as bottle openers and lining cutters.

On the other two opposing sides of the central piece may be conjugated with two large sides attached with slotted pockets for holding plates and dishware. At least four corner pieces are conjugated to the side pieces to with at least four pockets attached to hold napkins and utensils.

At least two bottle sleeves are attached to each side piece for holding beverages and other drink material. The bottle sleeves may be made insulating materials for keeping the beverages warm or cold.

With the zipping of the zippers at the two sides, the side panels are drawn together, fold regions are folded, and a bagging system is formed. A bottle opener may be attached to the handle of the zipper via a long tethering string for an easy to locate and easy to use aid.

With the forming of a bagging system, an exterior layer of storage space may be optionally formed by attaching another flexibly supporting layer or bottom to the central piece from outside the bagging walls, this layer may be conveniently used for the storage of a picnic blanket or a tablecloth.

A separate internal container bag is further provided to sit inside the bagging system, with tethers anchoring to the sides of the outside bagging system. This container bag may be used for food and consumable items and other supplies, and for containing garbage or leftovers after a picnic.

The above and other aspects, features and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
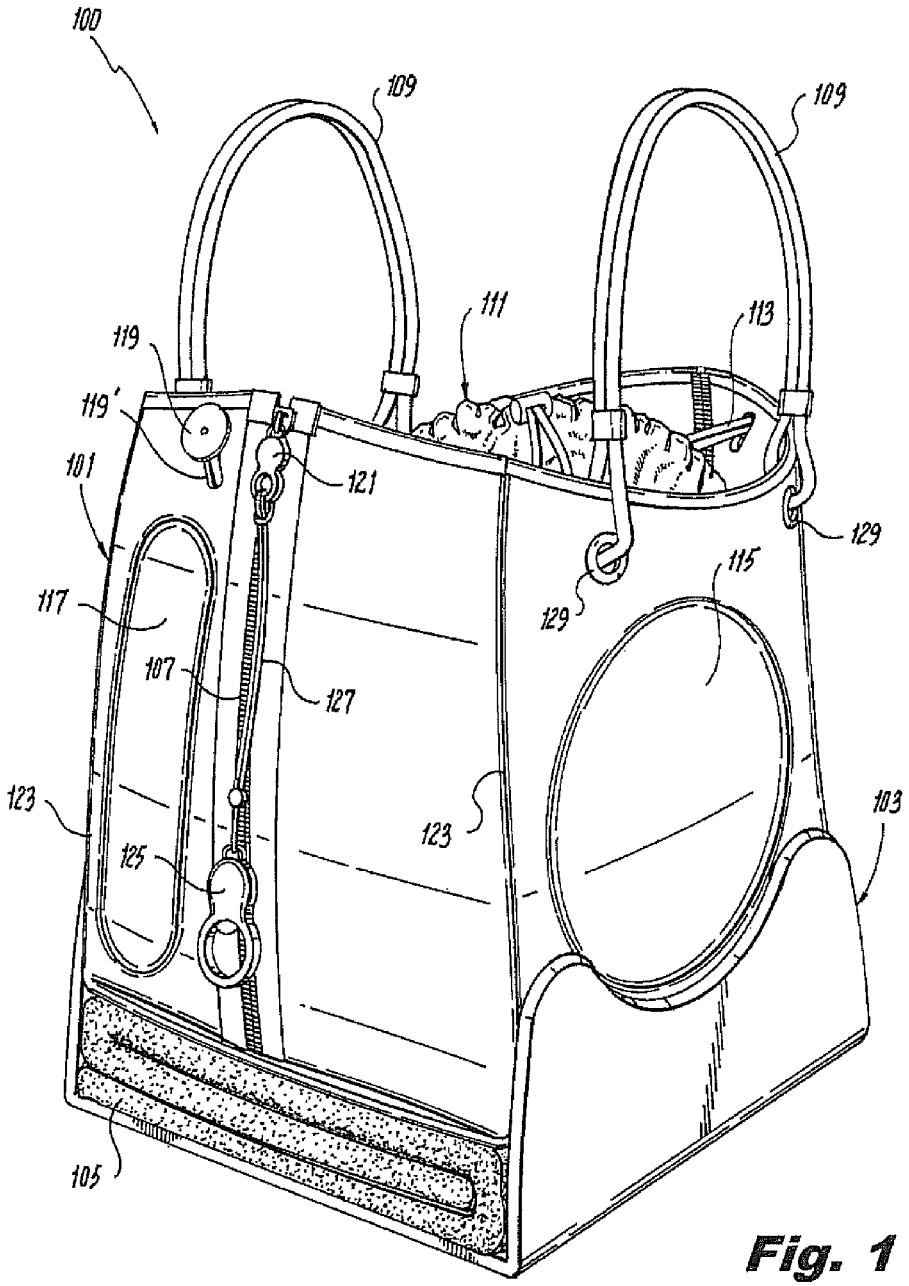
FIG. 1 is a perspective side view of an example picnic organizer package bagging system in accordance with this application.

Reference will now be made in detail to embodiments of the invention. Wherever possible, same or similar reference numerals are used in the drawings and the description to refer to the same or like parts or steps. The drawings are in simplified form and are not to precise scale. The word 'couple' and similar terms do not necessarily denote direct and immediate connections, but also include connections through intermediate elements or devices. For purposes of convenience and clarity only, directional (up/down, etc.) or motional (forward/back, etc.) terms may be used with respect to the drawings. These and similar directional terms should not be construed to limit the scope in any manner. It will also be understood that other embodiments may be utilized without departing from the scope of the present invention, and that the detailed description is not to be taken in a limiting sense, and that elements may be differently positioned, or otherwise noted as in the appended claims without requirements of the written description being required thereto.

The terms "first," "second," "third," "fourth," and the like in the description and the claims, if any, may be used for distinguishing between similar elements and not necessarily for describing a particular sequential or chronological order. It is to be understood that the terms so used are interchangeable. Furthermore, the terms "comprise," "include," "have," and any variations thereof, are intended to cover non-exclusive inclusions, such that a process, method, article, apparatus, or composition that comprises a list of elements is not necessarily limited to those elements, but may include other elements not expressly listed or inherent to such process, method, article, apparatus, or composition.

Various operations may be described as multiple discrete operations in turn, in a manner that may be helpful in understanding embodiments of the present invention; however, the order of description should not be construed to imply that these operations are order dependent or that all aspects of a particular system described together are required and mandated. Instead, it is the claims that set the boundaries and scopes of the selected features.

In reference to FIG. 1, a foldable picnic organizer bagging system 100 is shown to be folded into a cuboid shaped or cubic shaped body 101. Two carrying strips 109 are attached to the two opposing sides via two mounting holes 129 at each side. Strip 109 forms a continuous loop that can be carried in double strands for short hand carrying or be enlarged into a single strand for shoulder carrying. A separable container bag 111 is releasably-anchored to two opposing sides via a pair of button members 119 and connecting strings 113 receivable within slots, as shown. Double layers are formed to hold plates and utensils on the side walls, or to receive glass-bases on a bottom surface (as shown). Pockets 115 are formed in generally circular form for holding plates and dishware, with an access opening. Pockets 117 are formed in elongated rectangular shape for holding utensils and napkins. The bagging body 101 is zipped with a pair of zippers 107 on the two opposing side walls, and the sippers are attached with a finger handle 121 for easy holding and grasping. On the finger handle may be tethered with an attaching string 127 that anchors a bottle opener 125. At the bottom another rigid layer separable bottom holder 103 may be attached to form a separate storage space for a blanket, a spread or a tablecloth 105. The sides are formed along seam lines 123 for easy folding and for maintaining the bagging system in shape so that sufficient supporting strength can be provided for transporting and storing the fragile dishes and glassware.

Figure 2:
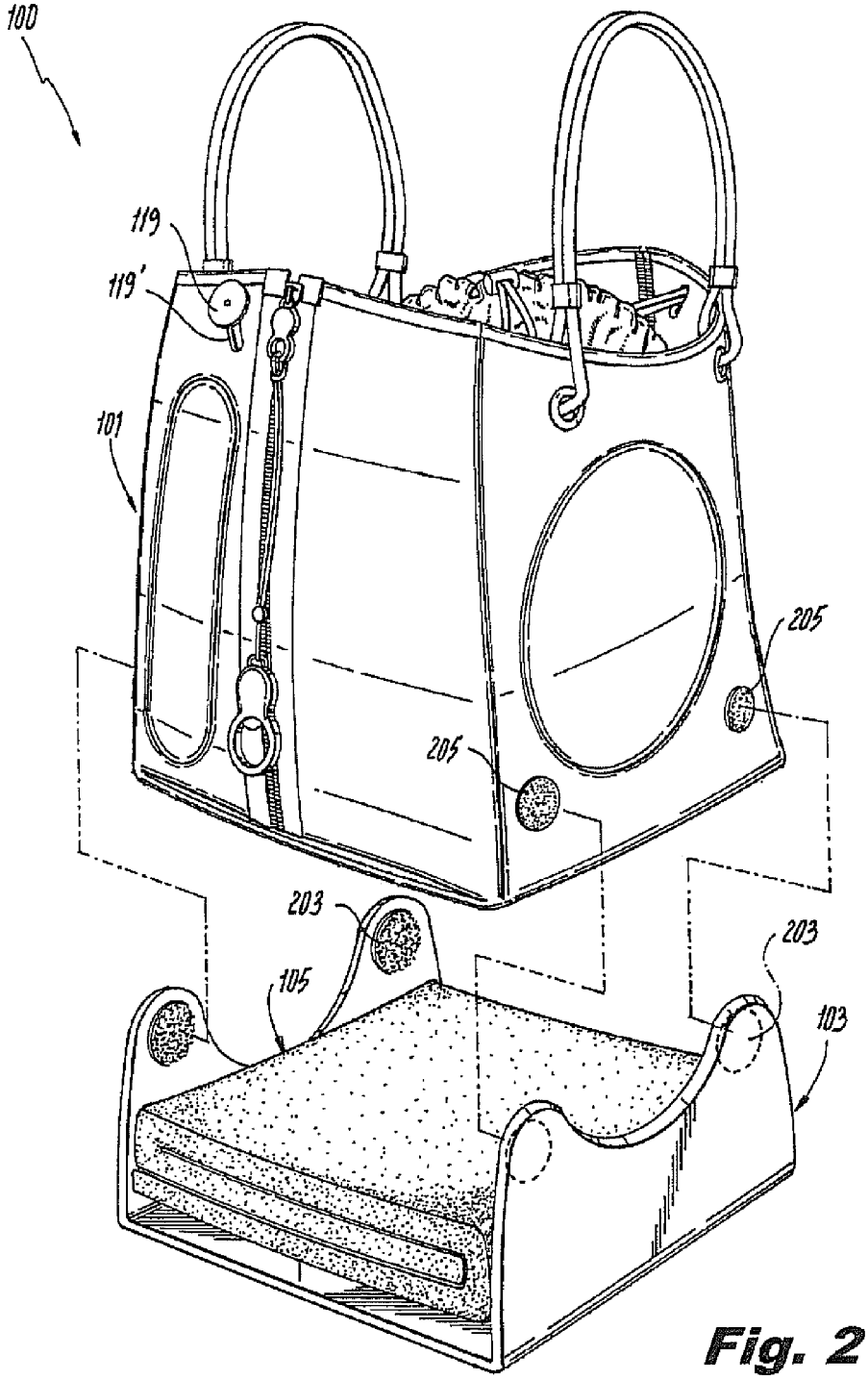
FIG. 2 is an expanded view from the bottom side of an example picnic organizer package bagging system in accordance with this application.

In reference to FIG. 2, the bottom layer 103 may be repositionably (open/closed) attached to the bottom of the bagging system 100 through a plurality of VELCRO® tapes 205. Bottom layer 103 may be in square or rectangular shape that fittingly matches to the bottom piece of bagging 100.

Figure 3:
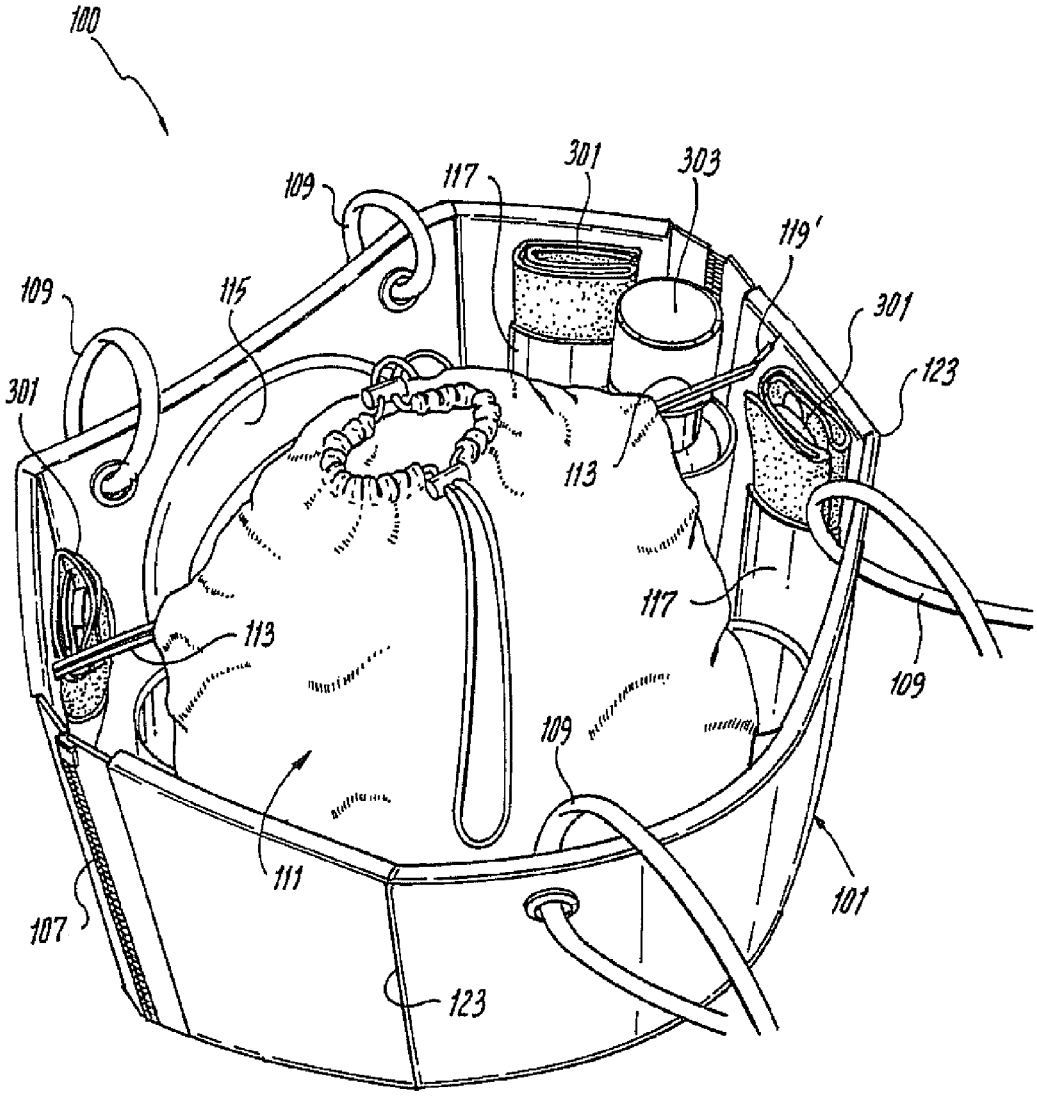
FIG. 3 is a perspective view from the top side of an example picnic organizer package bagging system in accordance with this application.
Figure 4:
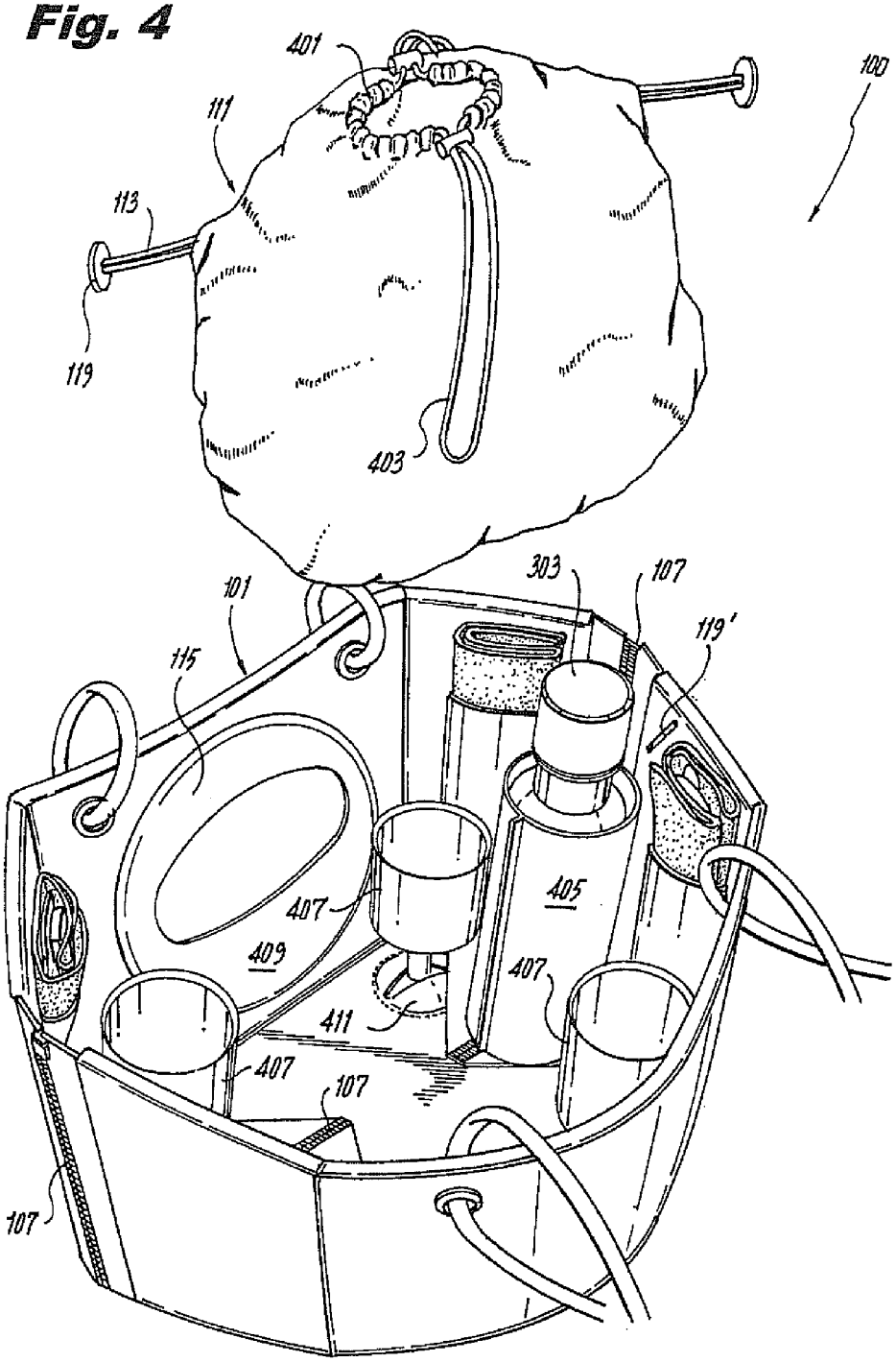
FIG. 4 is an expanded view from the top side of an example picnic organizer package bagging system in accordance with this application.

In reference to FIGS. 3 and 4, interior pockets 117 are packed with napkins/utensils 301 on the at least two opposing side walls of body 101, and on the other two opposing walls are holding pockets 115 for plates. Separable bag 111 is anchored to the side walls with two balancing tethering anchoring means 113 and 119. A beverage bottle 303 is sleeved to a side wall via a sleeve 405 that is seamed to one of the side walls. Plurality of glassware 407 may be anchored to the bottom side of bagging system 100 via slotted glassware pouches 411. Pockets 115 may be slotted with slots 409 for inserting plates and holding plates. These pockets and anchors are made of fabric materials with elasticity that apply a grasping strength for holding plates and glassware in place.

The internal bag 111 may be a pliable bag with a draw cord 403 threaded through a hem 401 to close the opening of the bag, holding food supply and other items securely inside the bag. The tethering means 113 are balanced at two opposing directions, so that the internal bag 111 is held securely inside bagging system 100 for transportation.

Figure 5:
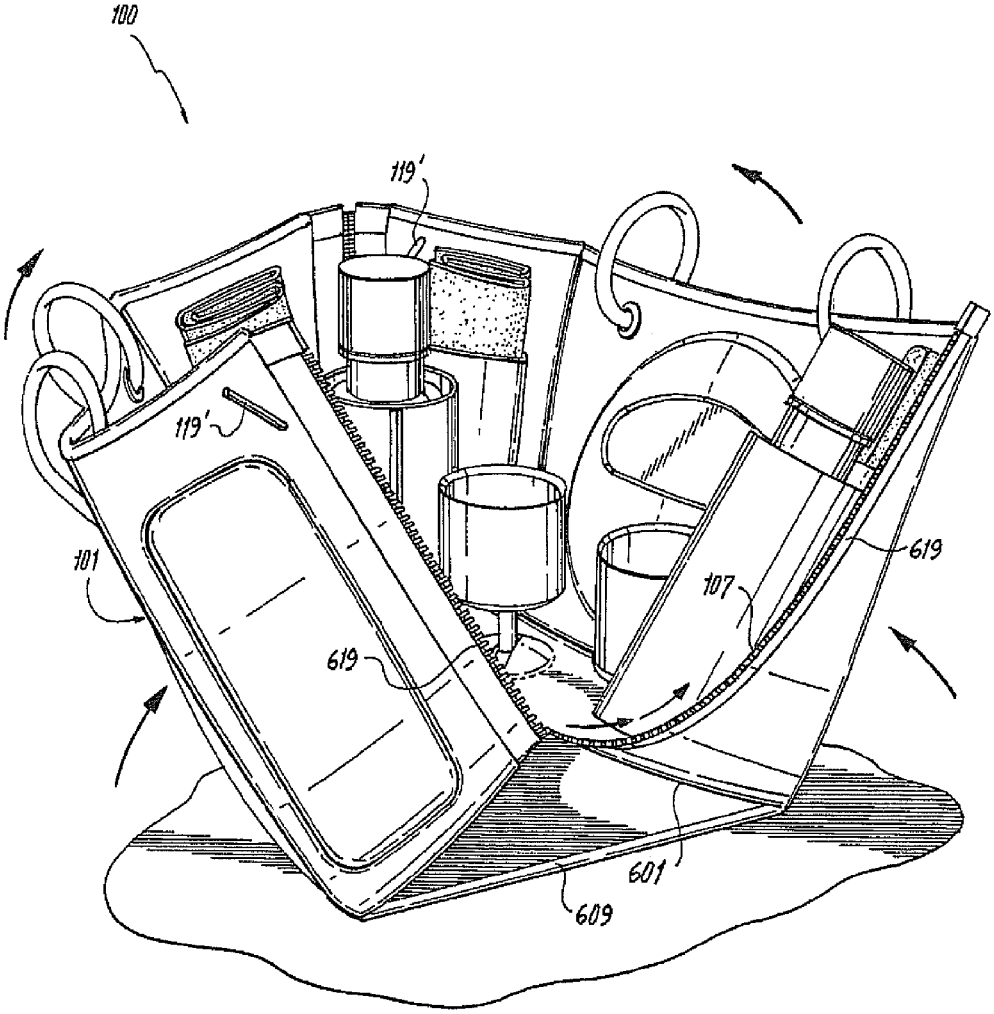
FIG. 5 shows a zipping up process in motion of an unfolded example picnic organizer package bagging system in accordance with this application.
Figure 6:
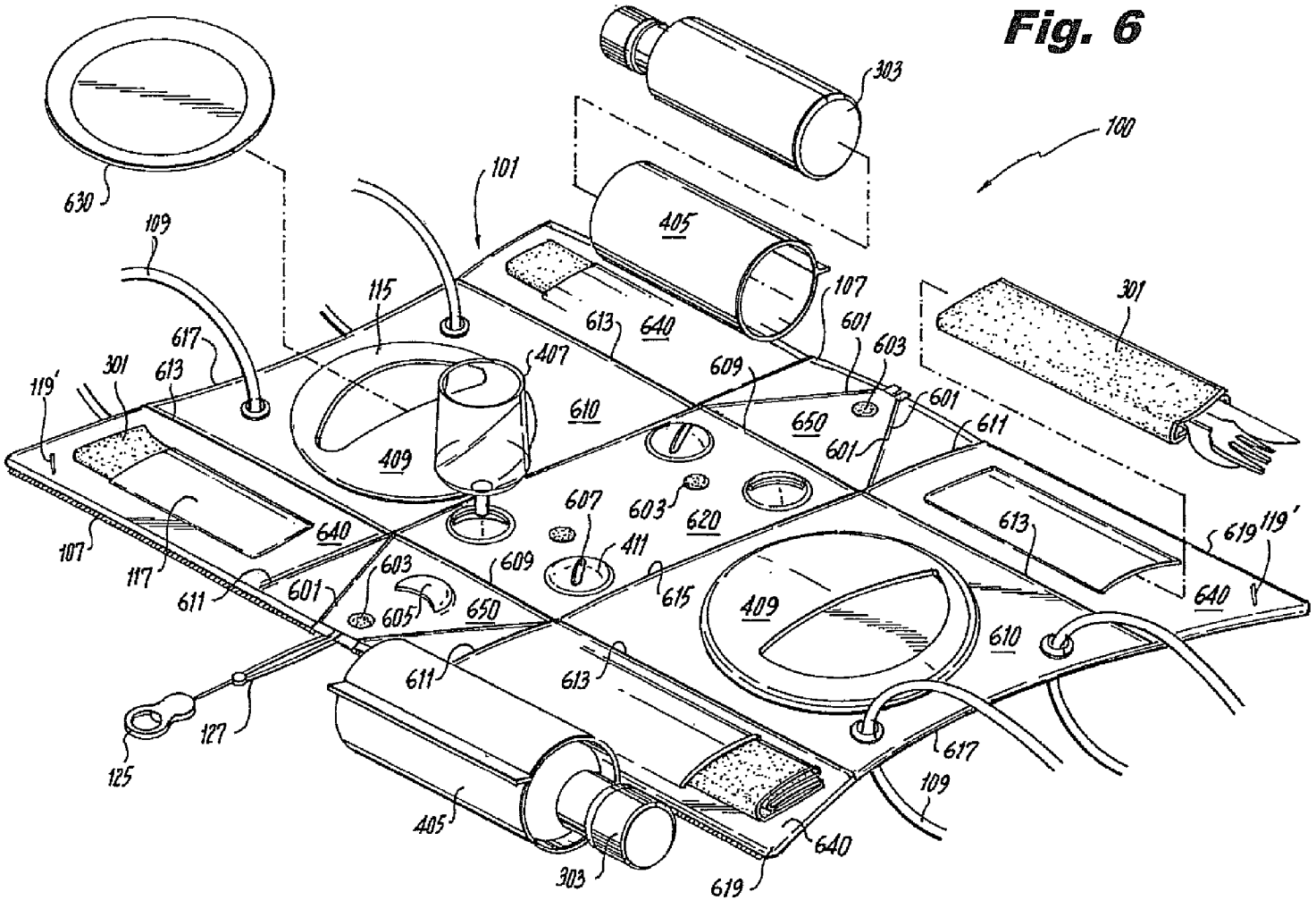
FIG. 6 is a perspective view of an unfolded example picnic organizer package bagging system in accordance with this application.
Figure 7:
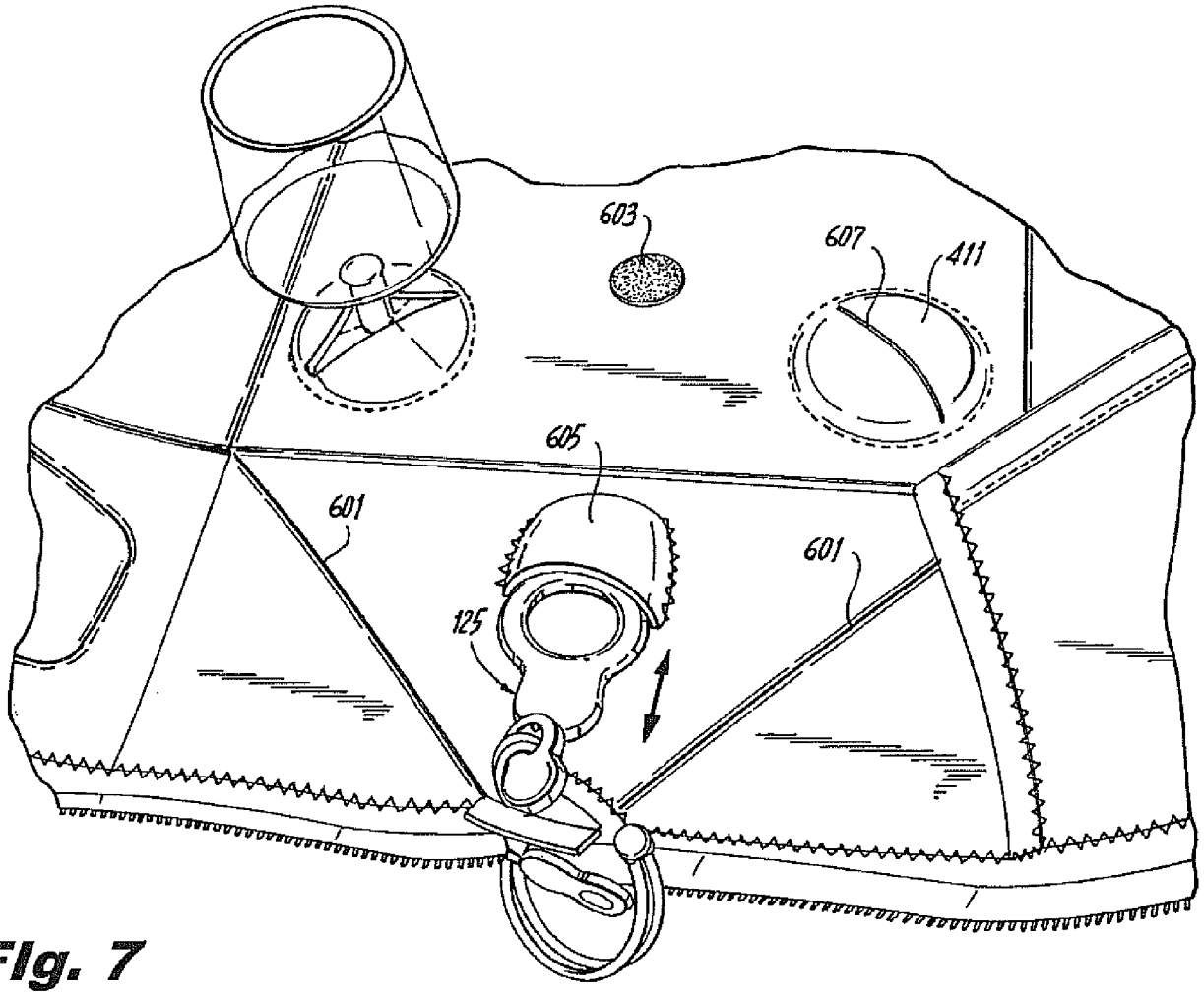
FIG. 7 is an enlarge view of the foldable section of an example picnic organizer package bagging system in accordance with this application.
Figure 8:
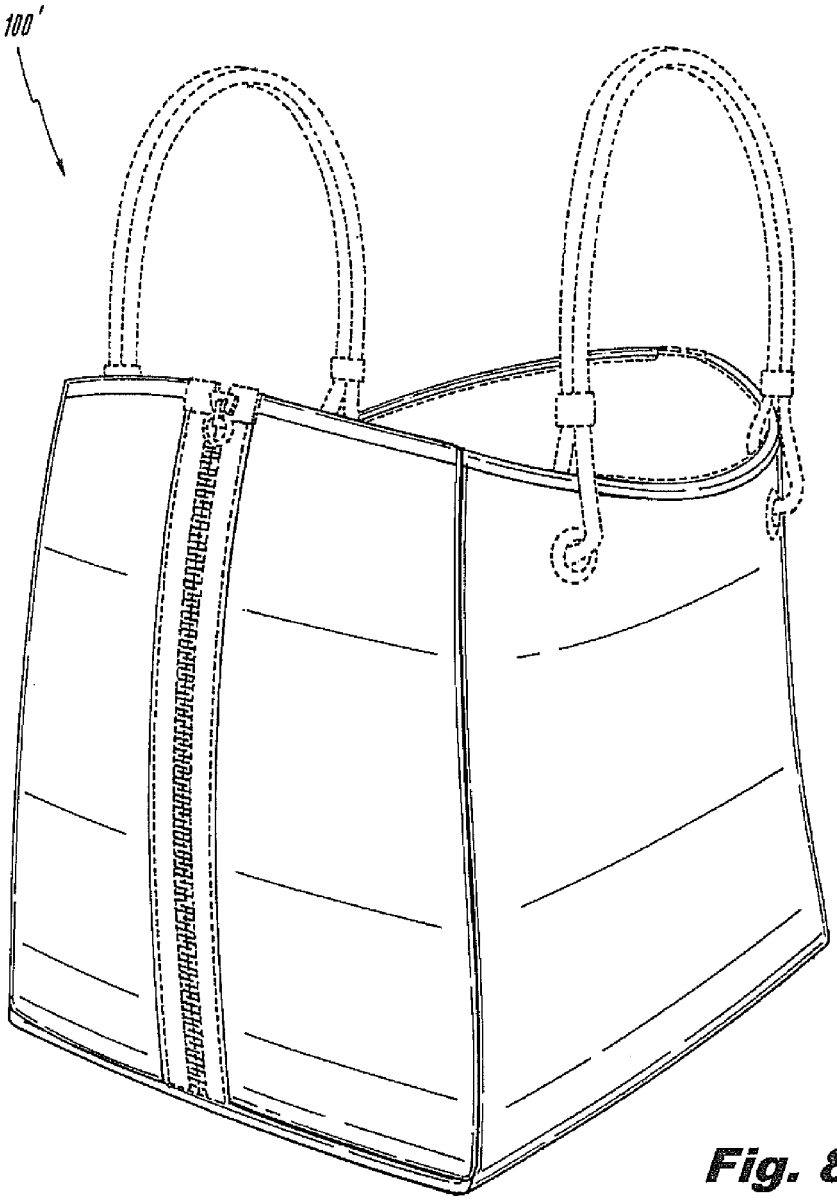
FIG. 8 is a perspective side view of an alternative organizer package system in accordance with this application shown in an ornamental view.
Figure 9:
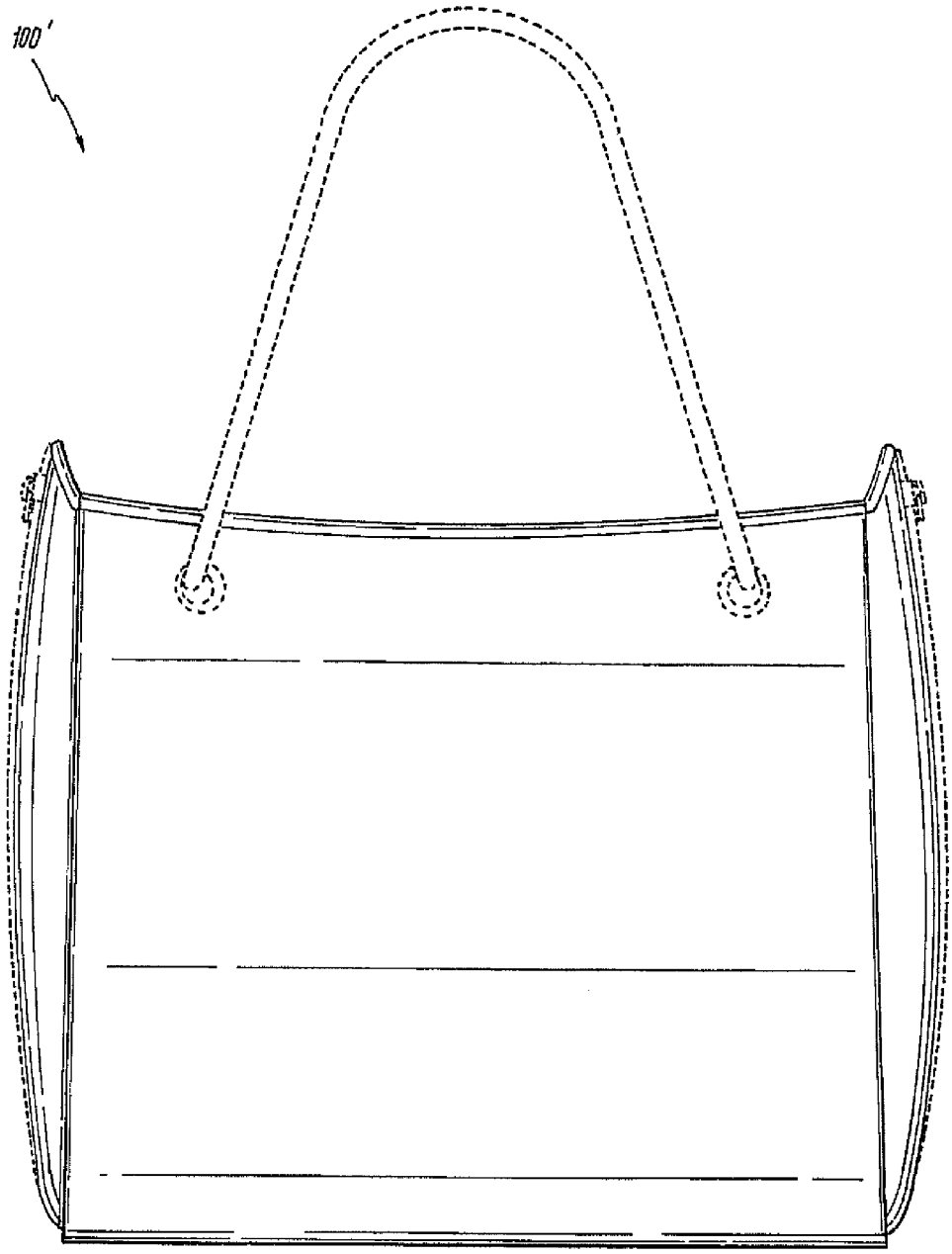
FIG. 9 is a right side elevation view of FIG. 8, the left side elevation view being a mirror image thereof, shown in an ornamental view.
Figure 10:
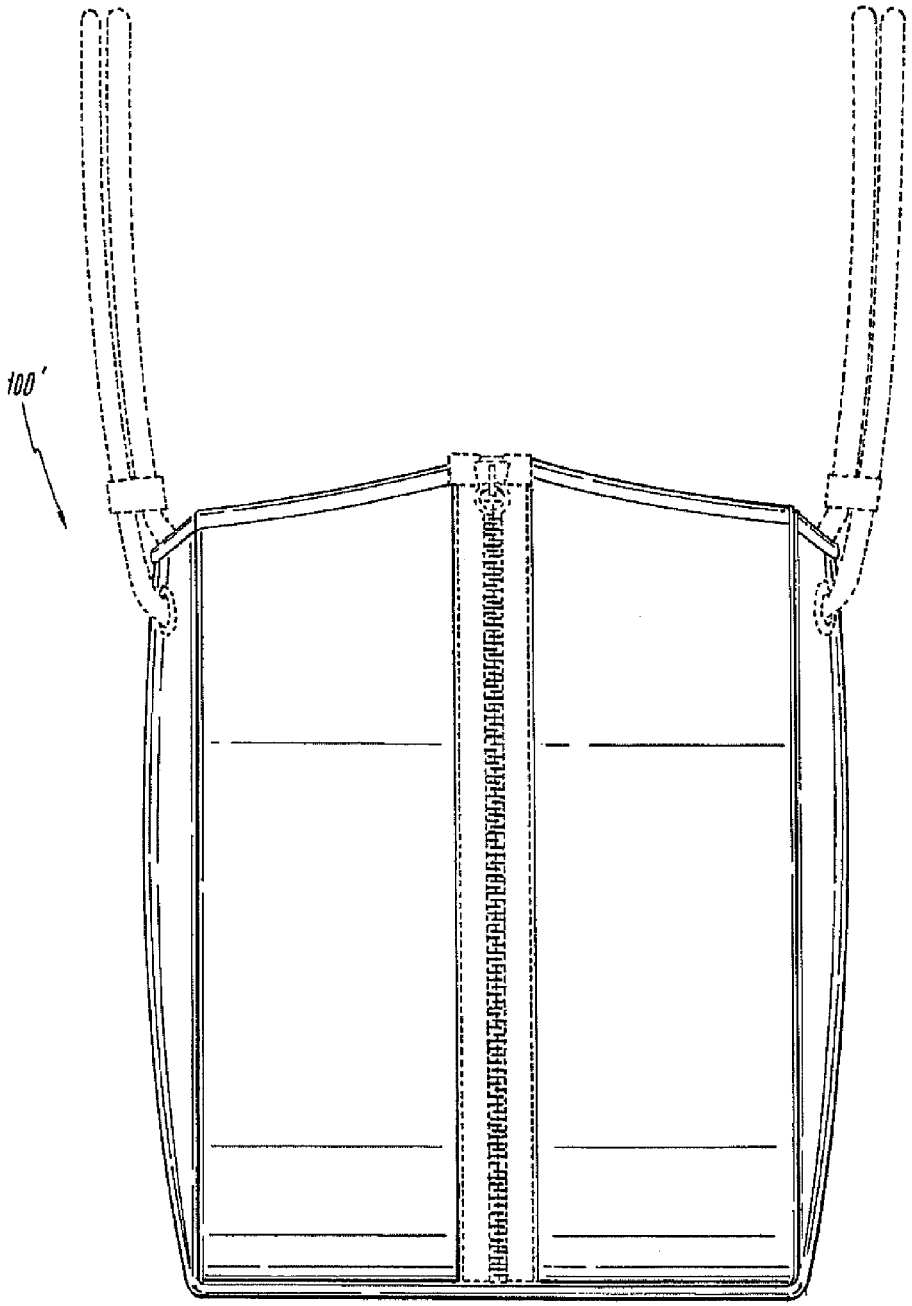
FIG. 10 is a front side elevation view of FIG. 8, the rear side elevation view being a mirror image thereof, as shown in an ornamental view.
Figure 11:
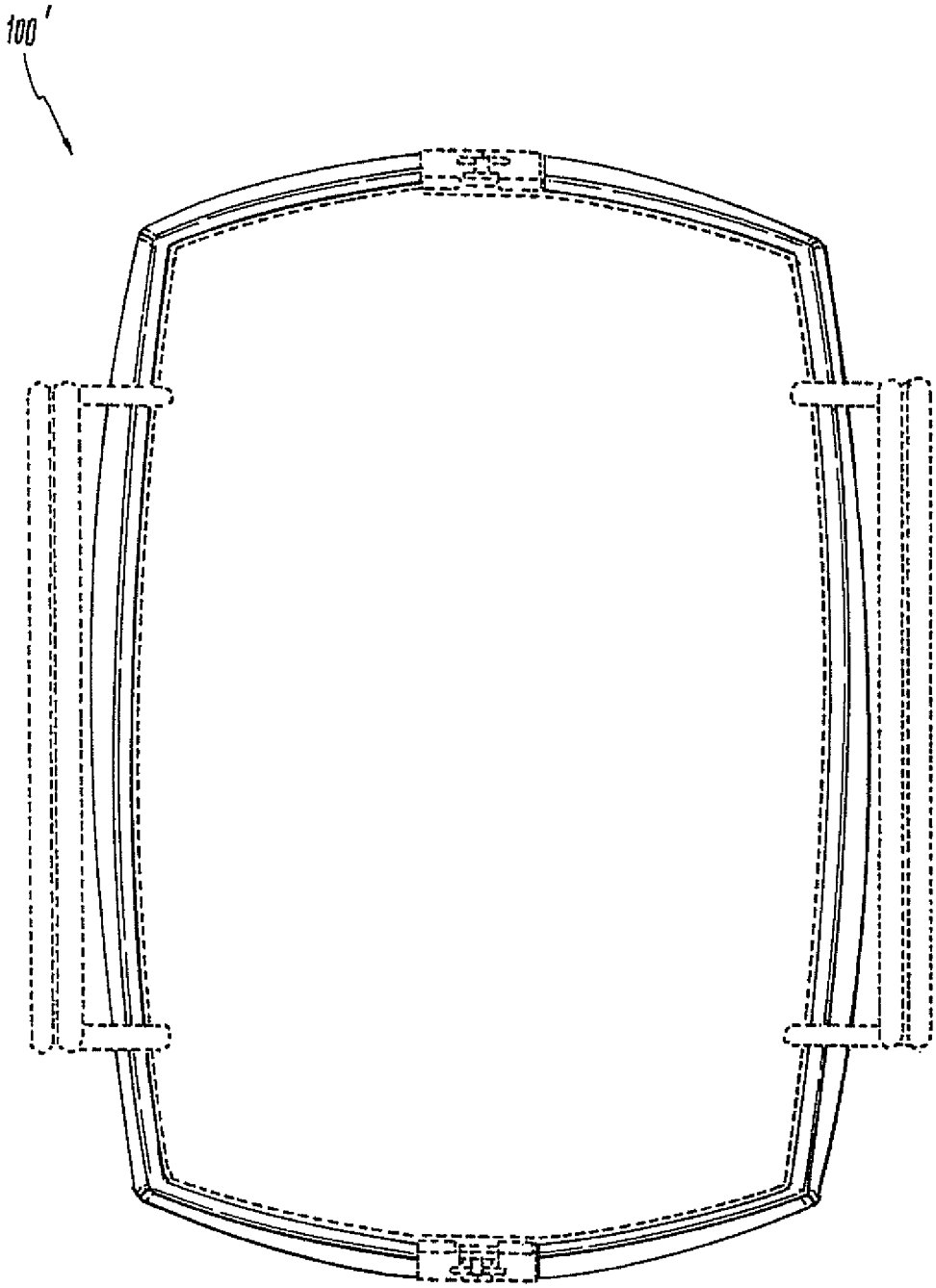
FIG. 11 is a bottom plan view of FIG. 8, shown in an ornamental view.
Figure 12:
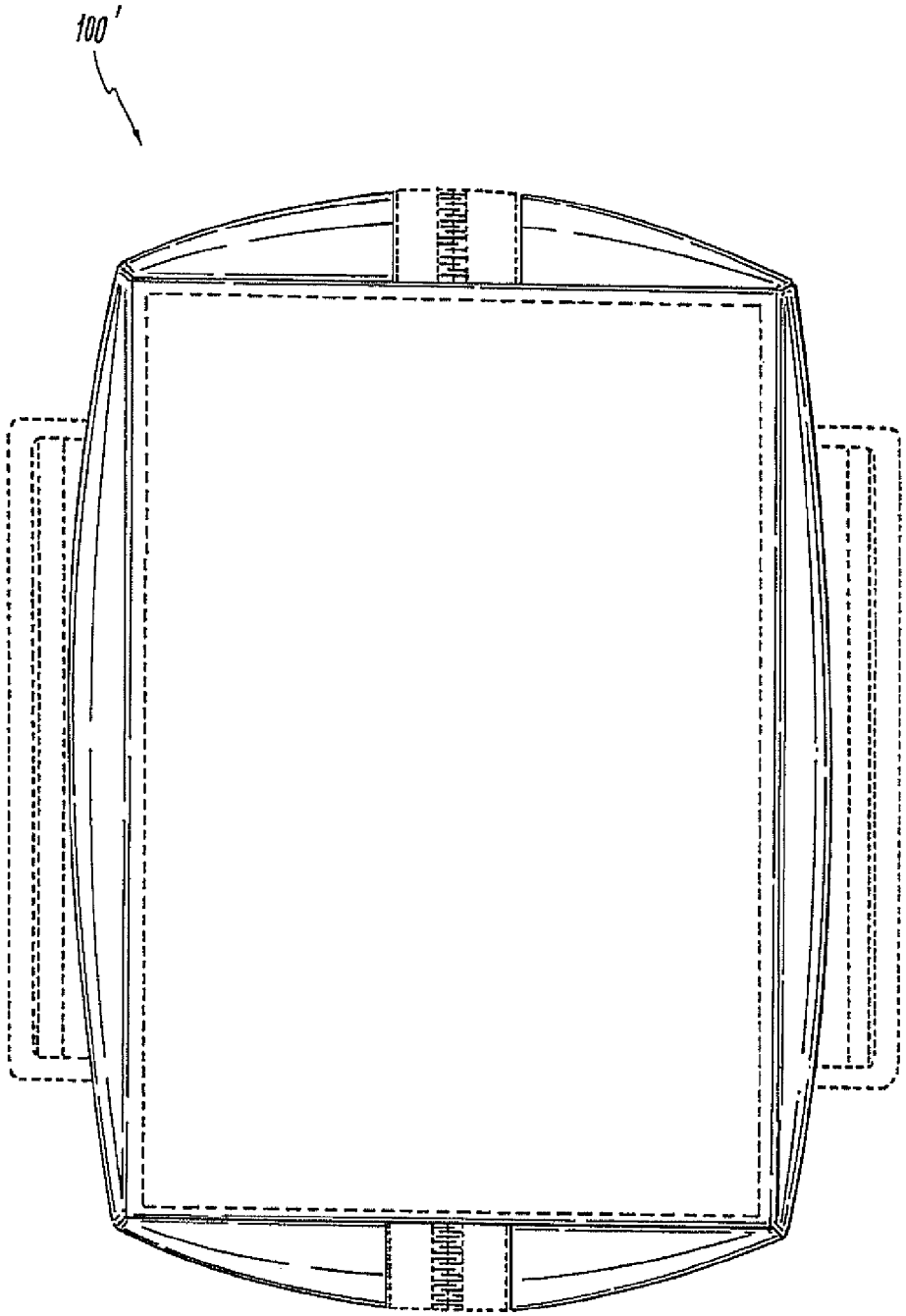
FIG. 12 is a top plan view of FIG. 8, shown in an ornamental view.

In reference to FIGS. 5 and 6, an unfolded picnic organizer bagging system 100 is shown. Foldable fabric cover sheet 101 with four peripheral sides 617 and 619 is formed by symmetrically conjugating and seaming a plurality of pieces of durable fabric materials for folding. Example durable fabric materials include mixed nylon and rubber materials, neoprene materials, mixtures of cotton and synthetic materials. A pair of peripheral zipper couples 107 are sewn to the two opposite sides 619 for pulling and fixing the cover sheet into a bagging system, while the other two opposing sides 617 are mounted with continuous carrying strings 109 for forming hand carrying short double loops or shoulder carrying single long loops.

The cover sheet 101 is consisting of at least two layers. A central rectangular or square piece material 620 that forms the bottom of the bagging comprises at least four slotted holders 411 at each corner for securely holding for glass-wares 407. Glassware holders 411 are slotted with slots 607 for holding the cups at their standing support. At two opposing sides 609 of central piece 620 are conjugated with seaming lines 609 with two side pieces 650 that are capable of being folded into three packed pieces with seam lines 601. VELCRO™ sticker tapes 603 are mounted to the central piece 620 and to the side pieces 650 for holding the folding sides 650 at the folded position at the bottom when a bagging is formed. A small pouch 605 may be attached to the foldable sides 650 for storing small items, such as bottle openers 125 and lining cutters.

On the other two opposing sides 615 of the central piece 620 may be conjugated with two large sides 610 attached with slotted circular pockets 115 for holding plates and dishware 630. Pockets 115 are configured with sufficiently large slots for inserting dishes and plates with ease. At least four corner pieces 640 are conjugated and seamed with seam lines 611 to the foldable side piece 650 and to side pieces 610 via seam lines 613 to shape the unfolded bagging sheet 111 into a full rectangular or square shape. At least four pockets 117 are respectively attached to each of the corner pieces 640 for holding napkins and utensils.

At least two bottle sleeves 405 may be attached to each side piece 640 for holding beverages and other drink material 303. The bottle sleeves 405 may be made of insulating materials for keeping the beverage warm or cold.

As shown in FIG. 5, with the zipping motion 501 of the zippers 107 at the two sides 619, side pieces 650 fold along seam lines 601 and 609, pulling up the lay-down side pieces and forming bagging walls. A bottle opener may be attached to the handle of the zipper via a long tethering string for easy to locate and easy to use.

In reference to FIGS. 8 to 12, an alternative foldable picnic organizer bagging system 100' is presented in an ornamental arrangement including the use of dashed lines to indicate disclaimed ornamental materials. While these disclaimed lines are noted, they provide information to the utility reader noting curvature of sides, handles, bottom region, and other details in full keeping with this disclosure.

As will be understood by those of skill in the art, the particular invention 100 (100') is particularly useful in transport and from converting from a use/carry position to an open/flat type position as shown in the drawings, to aid in a picnic-type use. To this end, the main panel member is foldable at a series of flexible seams that act as live hinges (places where the neoprene sheets are heat-seamed to aid folding) to create respectively positionable panels. In this way, a flat condition (FIG. 6) may be readily closed via a partial closed position (FIG. 5) to a fully closed position (FIG. 1), by connecting respective hook-and-loop closure members and zipping the respective zipper members. The first step being raising the hinge panels regions proximate the zipper juncture (see arrows FIG. 6) to secure the triangle-type panels to the bottom panel hook-and-loop closure members. This begins to rise the side panels and curve the body panels to allow the zippers to be respectively drawn together. In a second step, each side wall zipper is joined forming respective side walls and forming the overall bag together. In a third step, the inner pouch is secured, and in a fourth step the bottom panel and blanked are assembled therewith. For use, these steps are reversed and the product may be used in an open and flat condition.

Having described at least one of the preferred embodiments of the present invention with reference to the accompanying drawings, it will be apparent to those skills that the invention is not limited to those precise embodiments, and that various modifications and variations can be made in the presently disclosed system without departing from the scope or spirit of the invention. Thus, it is intended that the present disclosure cover modifications and variations of this disclosure provided they come within the scope of the appended claims and their equivalents.

None of the description in the present application should be read as implying that any particular element, step, or function is an essential element which must be included in the claim scope: THE SCOPE OF PATENTED SUBJECT MATTER IS DEFINED ONLY BY THE ALLOWED CLAIMS. Moreover, none of these claims are intended to invoke paragraph six of 35 USC section 112 unless the exact words "means for" are followed by a participle.

The claims as filed are intended to be as comprehensive as possible, and NO subject matter is intentionally relinquished, dedicated, or abandoned.

What is claimed is:

1. A organizer bagging system, comprising:

a central rectangular fabric piece having a first pair of opposing sides and a second pair of opposing sides, a plurality of slotted pockets attached to said central rectangular fabric piece for holding a glassware;

a pair of first side fabric pieces seamed to the first pair of opposing sides, wherein each of said first side fabric pieces is foldable along a seam line on said first side fabric pieces respectively;

a pair of second side fabric pieces seamed to the second pair of opposing sides, a slotted pocket is respectively attached to said second side fabric pieces to hold a dishware; and a plurality of corner fabric pieces simultaneously seamed to said first side fabric pieces and said second side fabric pieces, wherein a pocket for holding utensils is attached to said corner fabric piece, wherein said central rectangular fabric piece, said pair of first side fabric pieces, said pair of second side fabric pieces and said plurality of corner fabric pieces form a flat fabric sheet, wherein said first side fabric pieces and said corner fabric pieces form a pair of first peripheral sides, and a closing mechanism is mounted to said first peripheral sides for closing said flat fabric sheet into said organizer bagging system having a peripheral side wall and a bottom side.

2. The organizer bagging system of claim 1, further comprising a separable container bag having anchors to anchor into said peripheral side wall.

3. The organizer bagging system of claim 1, further comprising a separable bottom layer removably mountable to said side walls underneath said bottom side, and forming a separate bottom space for storing a blanket or a tablecloth.

4. The organizer bagging system of claim 1, wherein a plurality of hook and loop tapes are attached to said central rectangular fabric piece and said pair of first side fabric pieces for holding said first side fabric pieces in a folded position.

5. The organizer bagging system of claim 1, wherein a plurality of glassware is held to the central rectangular fabric piece via the slotted pockets on the central rectangular fabric piece; and a plurality of utensils are stored to the pockets on the plurality of corner fabric pieces; and a set of dishware is inserted into said slotted pockets on said second side fabric pieces.

6. The organizer bagging system of claim 1, wherein a set of carrying strips is looped via a pair of mounting holes on said second side fabric pieces.

7. A method for providing an organizer bagging system, comprising:

constructing a central rectangular fabric piece having a first pair of opposing sides and a second pair of opposing sides, wherein a plurality of slotted pockets are attached to said central rectangular fabric piece for holding a glassware;

constructing a pair of first side fabric pieces seamed to the first pair of opposing sides, wherein each of said first side fabric pieces is foldable along a seam line on said first side fabric pieces respectively;

constructing a pair of second side fabric pieces seamed to the second pair of opposing sides, wherein a slotted pocket is respectively attached to said second side fabric pieces to hold a dishware;

constructing a plurality of corner fabric pieces simultaneously seamed to said first side fabric pieces and said second side fabric pieces, wherein a pocket for holding utensils is attached to said corner fabric piece, wherein said central rectangular fabric piece, said pair of first side fabric pieces, said pair of second side fabric pieces and said plurality of corner fabric pieces form a flat fabric sheet, and wherein said first fabric pieces and said corner fabric pieces form a pair of first peripheral sides, and a closing mechanism is mounted to said first peripheral sides, and said closing mechanism closes said flat fabric sheet into a picnic organizer bagging system.

* * * * *